US005458103A

United States Patent [19]

Lauvin

[11] Patent Number: 5,458,103

[45] Date of Patent: Oct. 17, 1995

[54] FUEL INJECTION ARRANGEMENT FOR INTERNAL COMBUSTION ENGINES

[75] Inventor: Pierre Lauvin, Stuttgart, Germany

[73] Assignee: Robert Bosch GmbH, Stuttgart, Germany

[21] Appl. No.: 251,993

[22] Filed: Jun. 1, 1994

[30] Foreign Application Priority Data

Jun. 1, 1993 [DE] Germany ..... 43 18 078.7

[51] Int. Cl.[6] ..... F02M 57/02; F02M 47/00; F02M 63/04

[52] U.S. Cl. ..... 123/456; 123/467; 123/446

[58] Field of Search ..... 123/446, 447, 123/456, 467, 500, 501, 502

[56] References Cited

U.S. PATENT DOCUMENTS

| | | | |
|---|---|---|---|
| Re. 33,270 | 7/1990 | Beck et al. | 123/446 |
| 4,149,506 | 4/1979 | Muntean et al. . | |
| 4,271,807 | 6/1981 | Links | 123/467 |
| 4,333,436 | 6/1982 | Kopse et al. . | |
| 4,372,272 | 2/1983 | Walter et al. | 123/467 |
| 4,448,169 | 5/1984 | Badgley et al. . | |
| 4,605,166 | 8/1986 | Kelly | 123/446 |
| 4,721,247 | 1/1988 | Perr . | |
| 4,979,674 | 12/1990 | Taira et al. . | |
| 5,191,867 | 3/1993 | Glassey | 123/446 |
| 5,213,084 | 5/1993 | Linder et al. | 123/456 |
| 5,325,834 | 7/1994 | Ballheimer | 123/456 |
| 5,341,783 | 8/1994 | Beck et al. | 123/467 |

FOREIGN PATENT DOCUMENTS 2124699 2/1984 United Kingdom .

*Primary Examiner*—Thomas N. Moulis

*Attorney, Agent, or Firm*—Edwin E. Greigg; Ronald E. Greigg

[57] ABSTRACT

A fuel injection arrangement for internal combustion engines, having an injection unit embodied as an open nozzle, in which a pump piston embodied as a stepped piston defines two work chambers in a cylinder bore is proposed, by which work chambers a pump work chamber, defined by an annular end face in the pump piston portion of smaller diameter, can be made to communicate with a fuel supply line and an injection port into the combustion chamber of the engine to be supplied. The other work chamber, at least indirectly defined by the larger face end of the pump piston, can be made to communicate according to the invention with a pressure reservoir chamber or a relief line via a pressure line that includes a 3/2-way valve; the supply stroke motion of the pump piston is brought about by the delivery into the work chamber of the fluid under high pressure located in the pressure reservoir chamber.

5 Claims, 3 Drawing Sheets

75
17
25
31
47
43
29
53
55
51
13
39
37
35
33
41
63
27
61
45
21
57
59
49

FUEL INJECTION ARRANGEMENT FOR INTERNAL COMBUSTION ENGINES

BACKGROUND OF THE INVENTION

The invention is based on a fuel injection arrangement for internal combustion engines as defined hereinafter. In one such fuel injection arrangement, known from U.S. Pat. No. 4,721,247, a cam drive rotating in synchronism with the engine rpm drives an intermediate piston guided in a cylinder bore of a cylinder liner, and the piston in turn drives a pump piston, likewise guided in the cylinder bore, counter to the force of a restoring spring; a work chamber that can be filled with a hydraulic fluid is provided between the face ends facing one another of the intermediate piston and the pump piston. The pump piston is embodied as a stepped piston, whose larger face end defines the work chamber and which with its narrowed portion protrudes into a segment of reduced diameter of the cylinder bore, into the end of which remote from the pump piston injection ports to the combustion chamber of the engine to be supplied discharge, so that the cylinder bore is open toward the combustion chamber. On its narrowed end, the pump piston has a cross-sectional expansion, with which it defines a pump work chamber in the narrowed section of the cylinder bore; this chamber can be filled with fuel via a fuel supply line that can be opened by the jacket face of the pump piston, and this chamber communicates with the end of the cylinder bore that receives the injection ports. The face end of the narrowed part of the pump piston is also conically embodied and thus forms a conical sealing face, with which in the dead center position of the pump piston, after a maximum pumping stroke has been traversed, seals against a conical seat disposed in the cylinder liner and thus closes the communication with the injection ports.

The injection quantity is regulated by the degree of filling of the pump work chamber with fuel, while the instant of injection onset can be regulated by the filling of the work chamber with a medium (in this case fuel) acting as hydraulic fluid. The injection stroke of the pump piston is initiated by the closing of the supply line for the hydraulic fluid by the intermediate piston during its reciprocating motion, and as a consequence the enclosed pressure volume in the work chamber transmits the reciprocating motion of the intermediate piston hydraulically to the pump piston. The injection is terminated once the pump piston arrives with its conical sealing face at the seat in the cylinder bore and closes the communication with the injection ports into the engine combustion chamber. The pump piston in this position, with its larger face end toward the intermediate piston, controls a diversion bore of the work chamber, so that the hydraulic fluid can flow out as the stroke of the intermediate piston continues. The intermediate piston reaches its terminal position as a result of the contact with the larger face end of the pump piston, so that the latter, after the outflow of hydraulic fluid, is held mechanically by the intermediate piston in contact with its seat that closes the communication with the injection ports; this is necessary so that delayed injection of fuel into the engine combustion chamber will be reliably avoided.

The problem accordingly arises in the known fuel injection arrangement that the pump piston that closes the communication with the injection ports must be held mechanically on the seat in the cylinder bore at the end of the injection, which makes stringent requirements for adjustment tolerances necessary, while it can in turn be achieved only by difficult and expensive adjustment operations during the installation of the injection system in the engine. Moreover these adjustment tolerances can be strongly influenced by various operating parameters (temperature, wear), so that in the known fuel injection arrangement, the requisite adjustment accuracy for secure sealing over a long period of time only is attainable at very great effort and expense, and the danger of a major loss in efficiency from a leaking seat of the pump piston increases over a relatively long time in service.

Moreover, the fuel injection system, driven via a cam drive synchronous with the engine rpm, typically has the problem of an rpm-dependent high-pressure fuel pumping rate, where the maximum injection pressure is not available in all rpm ranges, and whose maximum pressure is no longer sufficient to meet the present high demands made of the injection pressure.

OBJECT AND SUMMARY OF THE INVENTION

The fuel injection arrangement according to the invention has the advantage over the prior art that by the actuation of the pump piston by means of a pressure fluid drawn from a common pressure storage chamber (common rail), the full injection pressure is attainable in any engine rpm range; even very high injection pressures are attainable without any problems because of the pressure boost by the pump piston embodied as a stepped piston. Controlling the injection pressure is advantageously done by controlling the pressure in the pressure storage chamber, and because of the separately controlled filling of the pump work chamber, the quantity of fuel injected is independent of the injection pressure.

Controlling the impingement of pressure fluid on the pump piston also has the effect that the pump piston, after the end of injection and after reaching its dead center position, is reliably kept in contact with the seat in the cylinder bore, so that the communication with the injection openings in the cylinder liner remains reliably closed until the next filling process. Because of this hydraulic holding of the pump piston on its seat in the cylinder bore, brought about by the high pressure at the pump piston, mechanical adjustment of the location of an intermediate piston during installation of the injection arrangement is unnecessary.

Another advantage is attained because the triggering of the work chamber is done by means of a magnet valve embodied as a 3/2-way valve, which connects the work chamber with the pressure reservoir or with a relief line, and which given a suitable mode of operation reliably avoids unintended injection of fuel into the engine combustion chamber. By supplying electrical current continuously, an undesired injection can be avoided, since the pump piston, after a single injection, is held in contact with its seat that closes the communication between the pump work chamber and the injection ports.

It is thus possible with the fuel injection arrangement of the invention to combine the advantages of an open injection nozzle, such as a low injection rate at the onset and a rapid closure at the end of injection, with the advantages of a common rail. The injection arrangement according to the invention is especially economical, because the pump piston and an injection valve member are reduced to a single part.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
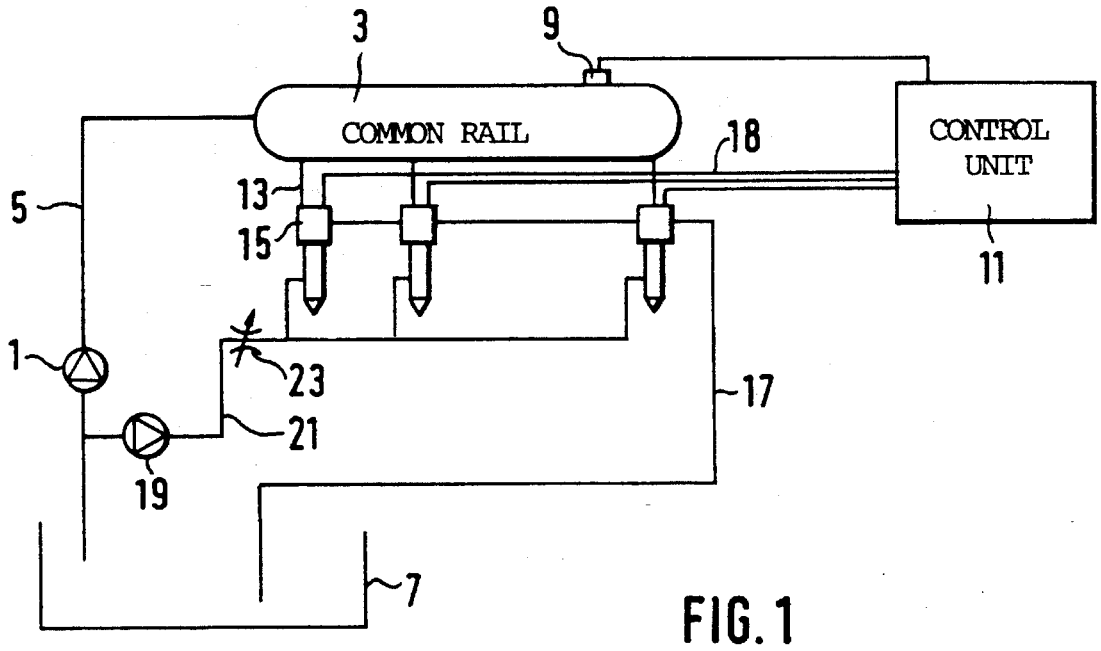
FIG. 1 is a schematic illustration of a first exemplary embodiment.

In the fuel injection arrangement schematically shown in FIG. 1, a high-pressure fuel pump 1 fills a common pressure reservoir chamber, or common rail 3, with fuel via a supply line 5 from a fuel supply tank 7. The pressure in the common rail 3 is detected by pressure measuring technology via a sensor 9 and carried to a control unit 11, which processes operating parameters of the engine to be supplied and, in order to vary or maintain the pressure in the common rail 3, triggers the high-pressure pump 1, or an additional control valve, not shown, in the supply line 5 or in a relief line of the common rail 3. From the common rail 3, pressure lines 13 lead away to the various injection units 15, which correspond in number to the number of cylinders of the engine to be supplied. The injection units 15 can be relieved from the high fuel pressure via a relief line 17 that discharges into the fuel supply tank 7, and the switchover between communication of the injection units 15 with the pressure line 13 or with the relief line 17 is done by means of a valve, to be described in further detail later, that is triggered by the electric control unit 11 via a control line 18. The quantity of fuel to be injected is delivered to the injection units 15 from the fuel supply tank 7 via a fuel supply line 21, which contains a low-pressure feed pump 19; filling of the injection unit 15 with the quantity of fuel to be injected is controllable via a low-pressure adjuster 23 (variable aspiration throttle) in the fuel supply line 21; this adjuster can be triggered in turn by the electric control unit.

FIG. 2A–FIG. 2E show the layout of the injection unit 15 of FIG. 1 in a sectional view. Disposed in a cylinder liner 25, which may be embodied in two parts, is a cylinder bore 27 embodied as a stepped bore, in which a pump piston 29, embodied as a stepped piston, is axially guided. The pump piston 29 is in contact, with its largest face end 31, with an intermediate piston 33 guided in the largest diameter of the cylinder bore 27; the intermediate piston 33, with its end face remote from the pump piston 29, defines a work chamber 35 in the cylinder bore 27, although if the pump piston 29 is suitably enlarged it is also possible to dispense with the intermediate piston 33. The work chamber 35 communicates via a pressure conduit 37 with a 3/2-way valve 39, which is actuated by an electric magnet valve 75 and which connects the work chamber 35 via the pressure conduit 37 either with the pressure line 13 to the common rail 3 or with the relief line 17 to the fuel supply tank 7. The magnet valve 75 is triggered by the control unit 11 via the control line 18.

On its end of largest diameter, oriented toward the intermediate piston 33, the piston 29 reduces its diameter via a shoulder 41 and thus, with its side of the shoulder 41 remote from the intermediate piston 33, defines a spring chamber 43 in the largest diameter of the cylinder bore 27; the spring chamber is defined on its other end by a shoulder 45 created by a reduction in diameter of the cylinder bore 27. A restoring spring 47 that urges the pump piston 29 in the direction of the work chamber 35 is fastened in this spring chamber 43 between the shoulder 45 and the shoulder 41. The pump piston 29 protrudes with its reduced diameter into a portion of the cylinder bore adjoining the shoulder 45 and likewise has a reduced diameter, whose end remote from the pump piston 29 has a conical valve seat 49, from whose sealing face one or more injection ports 51 lead away into the combustion chamber of the engine to be supplied; these injection ports may also lead away from a blind bore under the valve seat 49 (blind bore nozzle). On its reduced portion, protruding into the reduced-diameter part of the cylinder bore 27, the pump piston 29 has a cross-sectional reduction 53, with an annular face 53 pointing toward the valve seat 49, with which face it defines a pump work chamber 55 in the part of the cylinder bore having the reduced diameter. This pump work chamber 55 is defined in the direction of the injection ports 51 via a further diameter reduction of the cylinder bore 27 and communicates continuously (when the pump piston 29 is lifted from the valve seat 49) with the injection ports 51 via a longitudinal groove or play between the pump piston 29 and the wall of the cylinder bore 27. For filling with fuel, an inflow conduit 57 that contains a throttle restriction discharges into the pump work chamber 55, which also communicates with the fuel supply line 21. The throttle restriction in the inflow conduit 57 serves the purpose of accurate fuel metering into the pump work chamber 55, which can be adjusted by metering the pressure which is adjustable by means of the low-pressure adjuster 23 in the fuel supply line 21 and the time of filling, adjustable by the magnet valve 75, and the 3/2-way valve 39. The throttle restriction in the inflow conduit 57 must be dimensioned such that even the smallest possible flow of fuel can still pass through continuously and without any air.

On its end toward the injection ports 51, the pump piston 29 has a conical sealing face 59, with which it can be brought into contact with the valve seat 49; the sealing face 59, when it contacts the valve seat 49, closes the communication with the injection ports 51.

For the purposes of cooling or lubrication of the pump piston 29, an inflow line 61 and a return line 63 discharge into the spring chamber 43; these lines may be connected to the fuel circuit of the engine.

Figure 3:
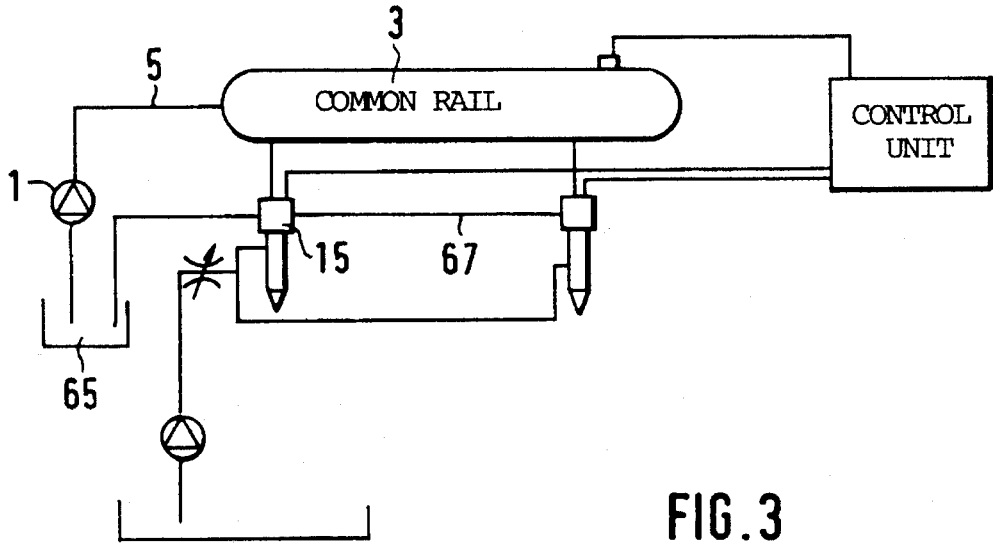
FIG. 3 is a schematic illustration of a second exemplary embodiment of the injection arrangement, in which the pressure fluid circuit is disconnected from the fuel circuit.

The second exemplary embodiment shown in FIG. 3 differs from the first in that the common rail 3, which fills the work chamber 33 to control the injection event, is filled from an oil supply container 65, which may be connected to the oil circuit of the engine. The second exemplary embodiment thus has two circuits separate from one another, whose structural layout is equivalent to that of the first exemplary embodiment, but whose pressure fluid for driving the pump piston 29 in the injection unit 15 is oil, which is taken from a separate supply container 65 analogously to FIG. 1, and which via a relief line 67, which corresponds to the original line 17, after diversion flows back into the supply container 65 again. The fuel circuit for filling the pump work chamber 55 with the quantity of fuel to be injected is preserved in the manner described for FIG. 1.

Figure 4:
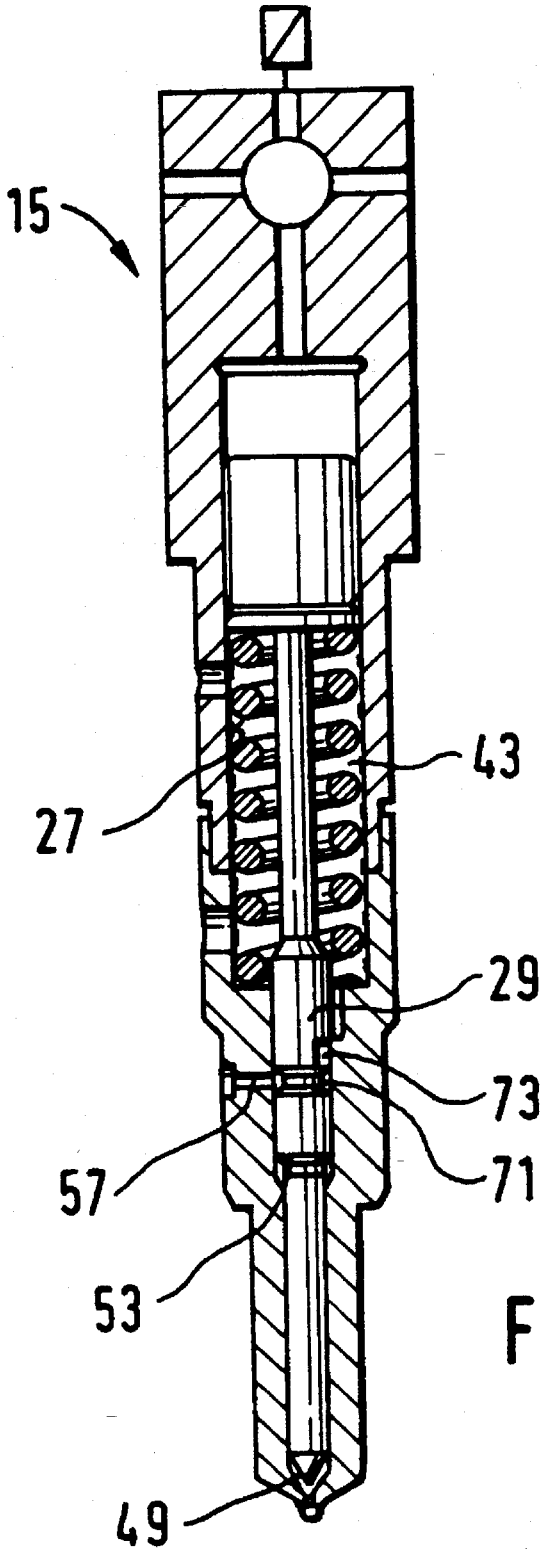
FIG. 4 shows a second exemplary embodiment of the injection unit, with a pump piston that has a scavenging groove.

The further exemplary embodiment shown in FIG. 4 has a second design option for the injection unit 15, in which for better scavenging and cooling of the pump piston 29 an annular groove 71 is machined into the portion of the pump piston 29 located on the spring side upstream of the end face 53 and plunging into the cylinder portion having the reduced diameter; when the pump piston 29 is in contact with the valve seat 49, this annular groove comes to coincide with the inflow conduit 57. From this annular groove 71, a longitudinal groove 73 leads away in the pump piston 29 or in the wall of the cylinder bore 27; it discharges into the spring chamber 43, so that the fuel can flow along the pump piston 29 into the spring chamber 43, thereby achieving improved cooling of the pump piston 29.

The mode of operation of the fuel injection arrangement according to the invention will be described in further detail below with the aid of FIGS. 1 and 2A–2E.

First, a pressure buildup controlled by the control unit 11 takes place in the common rail 3, via the high-pressure pump 1. Filling of the pump work chamber 55 of one of the injection units 15 now takes place as shown in FIG. 2 A, in that the work chamber 35 is made to communicate with the relief line 17 via the 3/2-way valve, which is equivalent to a currentless state of the magnet valve 75 at the 3/2-way valve. Because of the relieved work chamber 35, the restoring spring 47 moves the pump piston 29 to its top dead center position, and in this position the pump piston 29 has opened the inflow opening 57; that is, the annular end face 43 on the pump piston 29 is located above the inflow conduit 57. Via the pressure in the fuel supply line 21, which is variable by means of the low-pressure adjuster 23, the quantity of fuel flowing into the pump work chamber 55 can now be determined precisely as a function of the throttle cross section in the inflow conduit 57, so that via the inflow time, which is determinable by the position of the 3/2-way valve 39, the filling quantity is precisely determined, and so the maximum possible quantity is determined by the dimensioning of the pump work chamber 55.

Figures 2A, 2B, 2C, 2D, 2E:
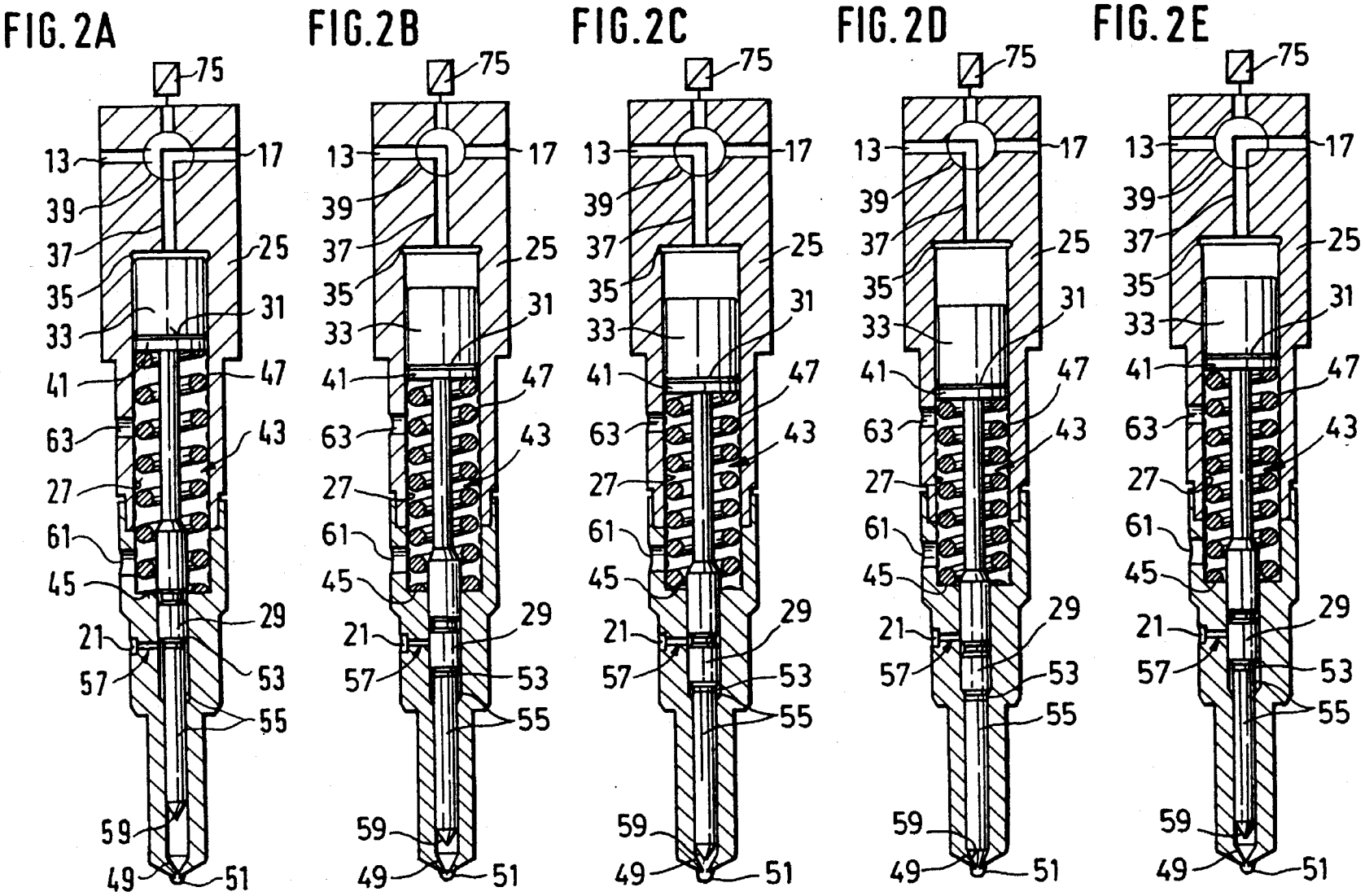
FIG. 2A–FIG. 2E show the structural layout of the injection unit of the injection arrangement, with the pump piston and injection ports of FIG. 1, in various work positions.

If high-pressure injection is now to take place, then as shown in FIG. 2 B, first the magnet valve 75 is provided with electric current, and the 3/2-way valve is switched over so that the work chamber 35 communicates with the pressure line 13. As a result of the pressure buildup in the work chamber 35, the pump piston 29 is moved toward bottom dead center counter to the force of the restoring spring 47; a pressure boost in the pump work chamber 55 can be achieved via the ratio of the end face areas (annular end face 53 to largest end face 31) of the pump piston 29. With the pump work chamber 55 filled completely, first some of the fuel located in it is positively displaced from it. Once the annular end face 53 on the pump piston 29 that defines the pump work chamber 55 overtakes the overflow conduit 57, the overflow conduit is opened by the piston jacket face, and the pump work chamber 55 is closed. As the pump piston stroke continues, the idle volume that is present given partial filling of the pump work chamber 55 is now positively displaced, until at a particular pump piston stroke a pressure rise takes place in the pump work chamber 55, in which the fuel located in it is injected via the injection ports 51 into the engine combustion chamber (FIG. 2C). Because of the steady buildup of pressure in the pump work chamber 55, an advantageous shaping of the injection course can be achieved, with an initially slight pressure at the onset of injection, which then rapidly is boosted to its maximum value as the pump piston stroke continues.

The end of injection shown in FIG. 2D is controlled by the contact of the pump piston 29 with the valve seat 49; the sealing face 59 on the pump piston 29 closes the communication with the injection ports 51. This end of injection, defined structurally by the attainment of the dead center position of the pump piston 29, is constant, and so the quantity of injection can be adjusted merely via the degree of filling of the pump work chamber 55.

The onset of injection is determined by means of the switchover of the 3/2-way valve 39 and with a very slight delay is identical to the onset of the inflow of pressure fluid from the pressure line 13 into the work chamber 35. The pump piston 29, as filling of the work chamber 35 begins, initially executes a very rapid piston stroke, in which the residual air or idle volume present in the pump work chamber 55 is compensated for, so that the onset of filling of the chamber 35 is also the onset of the supply stroke motion of the pump piston 29 and the onset of injection at the injection ports 51.

The filling rate and the filling pressure, which is adjustable in the common rail 3, of the work chamber 35 thus determine the feed rate of the injection unit 15, and the injection quantity is defined via the precisely metered quantity of fuel in the pump work chamber 55.

To enable a new injection by the injection unit, the 3/2-way valve is switched over again as the process continues, so that as shown in FIG. 2E the work chamber 35 is again pressure-relieved via the relief line 17, and the restoring spring 47 can again move the pump piston 29 into its top dead center position, in which the pump work chamber 55 again communicates with the inflow conduit 57.

The 3/2-way valves of the various injection - units, which regulate the injection timing, are triggered by the control unit via the magnet valves 75 in a chronologically staggered fashion at a certain spacing, and the control unit in turn processes operating parameters of the engine to be supplied.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection arrangement for internal combustion engines, having an injection unit (15), which has a pump piston (29), said pump piston is axially driven counter to a force of a restoring spring (47) in a cylinder bore (27), which is embodied as a stepped bore, the pump piston (29) being embodied as a stepped piston in a cylinder liner (25) with its largest end face at least indirectly defining a work chamber (35) that can be filled with a fluid via a pressure line (13), and the pump piston protrudes, by a portion of reduced diameter, into a part of the cylinder bore (27) of reduced diameter that is provided with injection ports (51) which lead into a combustion chamber of the engine to be supplied and there, via an annular end face (53) formed by a cross-sectional reduction, defines a pump work chamber (55) that can be made to communicate with a fuel supply line (21, 57) and discharges into the injection ports (51) and with its smallest face end (49), in a specific pump piston position, closes the communication with the injection ports (51), the work chamber (35) can be acted upon by a pressure fluid, controlled by a 3/1-way valve (39) via a pressure line (13, 37) from a common pressure reservoir chamber (3) and can be relieved via a relief line (17), wherein the common pressure reservoir chamber (3) can be filled, with fluid at high pressure and regulatable via a high-pressure pump (1) which serves to supply a plurality of injection units (15), the quantity of fuel to be injected is pumped by means of a low-pressure pump (19) from a supply tank (7) into the pump work chamber (55) via the fuel supply line (21), and the degree of filling of the pump work chamber (55) is adjustable via an adjusting member (23) in the fuel supply line (21).

2. A fuel injection arrangement as defined by claim 1, in which the common pressure reservoir chamber (3) is connected to a fuel circuit of the engine and is supplied from the fuel supply tank (7) via the high-pressure pump (1).

3. A fuel injection arrangement as defined by claim in which the adjusting member (23) is an adjustable throttle restriction.

4. A fuel injection arrangement as defined by claim 1, in which the common pressure reservoir chamber (3) is supplied from an oil circuit of the engine to be supplied.

5. A fuel injection arrangement as defined by claim 1, in which the 3/2-way valve (39) is triggered by means of an electric magnet valve (75), which in turn is triggered by an electric control unit (11) that processes various operating parameters of the engine.

* * * * *